United States Patent [19]

Goncharko

[11] 4,280,423

[45] Jul. 28, 1981

[54] DISPLAY ARRANGEMENT FOR GIVING A VISIBLE PATTERN CORRESPONDING TO ONE OR MORE STITCH PARAMETERS IN A SEWING MACHINE

[75] Inventor: Michael Goncharko, Union City, N.J.

[73] Assignee: The Singer Company, Stamford, Conn.

[21] Appl. No.: 179,384

[22] Filed: Aug. 18, 1980

[51] Int. Cl.[3] ..... D05B 3/02; D05B 79/00

[52] U.S. Cl. ..... 112/158 E; 112/158 F

[58] Field of Search ..... 112/158 E, 158 B, 121.11, 112/121.12, 158 F

[56] References Cited

U.S. PATENT DOCUMENTS

| | | | |
|---|---|---|---|
| 4,177,744 | 12/1979 | Wurst et al. | 112/158 E |
| 4,221,179 | 9/1980 | Miyao et al. | 112/158 E |

FOREIGN PATENT DOCUMENTS

| | | | |
|---|---|---|---|
| 2027462 | 2/1980 | United Kingdom | 112/158 E |

*Primary Examiner*—Peter P. Nerbun

*Attorney, Agent, or Firm*—David L. Davis; Robert E. Smith; Edward L. Bell

[57] ABSTRACT

A variable voltage, the magnitude of which corresponds to the controlled gain of a circuit through which stitch parameter controlling signals are passed is generated at the wiper arm of a potentiometer connected across a voltage source. The voltage thus obtained from the potentiometer is applied to a decoding circuit that has a plurality of output terminals to supply current to individual semiconductor devices that change their visible condition in response to such current. The decoder causes specific ones of the semiconductor devices to respond in that way so as to produce a pattern directly related to the gain of the circuit through which the stitch information passes. The decoder may be arranged to generate a bar graph representation of the gain or the change may be limited to the semiconductor device that represents the most extreme such device that would be affected by the voltage from the potentiometer for a given setting. Two devices that visibly display stitch parameters, such as the bight and feed, can be mounted on a sewing machine to provide visible information corresponding to modification of pattern size by a control that controls both the gain and the potentiometer from which the related voltage is obtained.

9 Claims, 2 Drawing Figures

DISPLAY ARRANGEMENT FOR GIVING A VISIBLE PATTERN CORRESPONDING TO ONE OR MORE STITCH PARAMETERS IN A SEWING MACHINE

DESCRIPTION

Background of the Invention

This invention relates to visible means to display, by a pattern of light, the magnitude of one or more stitch parameters, such as the stitch length and/or width in a sewing machine.

Sewing machines are commonly provided with control knobs for effecting settings of the stitch forming instrumentalities so as to control the length and width of stitches. In some instances, the control knobs have been simply calibrated by providing them with numbers to be placed opposite a pointer affixed to the front of the machine. Alternatively, the knobs have been provided with pointers to be placed opposite numbers printed on a fixed part of the machine. In other cases, small drawings have been printed, either on the control knobs or on the adjacent part of the machine, to give a more pictorial representation of the effect of rotating the control knobs. In still other instances, circuits have been provided in the machines to transform each control knob setting to a number displayed by a lighted display.

The disadvantage of representing the stitch parameters by numbers is that such information does not immediately make obvious to the operator the correlation between such numbers and the stitch parameters. In addition, information on unlighted dials may not be easily seen under the lighting conditions that prevail, since the attention of the operator is concentrated on the stitch forming region of the machine, and that region is usually illuminated by a light built into the machine.

State of the art sewing machines are currently incorporating increasing amounts of electronic controls and circuits, such as digital circuits that make it possible to generate a wide variety of stitch patterns from electronically stored stitch pattern information. The arrangement of stitches in these patterns is such that each pattern is produced within a given range of stitch sizes and covers a predetermined area of the work material. Of course, the individual stitches in a pattern may change in size, as for example, in the case of an arrowhead pattern, but within a given pattern the stitches always have a certain size relationship to each other.

It is frequently desirable to modify the size of a given pattern, for example, by making an arrowhead pattern narrower or longer than it would be if sewing in accordance with the stored stitch pattern information. In such case, the digital electronic information that governs the operation of the stitch forming instrumentalities in the formation of the pattern must be overridden by a manual control, as shown, for example, in U.S. Pat. No. 3,984,745, and it is then desirable that the operator have available a visible indication of the modification of stitch parameters from the standard bight and feed parameters that would normally be produced by the machine.

It is therefore an object of the present invention to provide improved display means for graphically representing operator controlled modification of a stitch parameter, such as the stitch length and/or width.

It is another object of this invention to provide separate display means for the length and width parameters of stitches in a pattern.

SUMMARY OF THE INVENTION

The foregoing and additional objects are attained in accordance with the principles of this invention in a sewing machine having stitch forming instrumentalities positionally controlled over a predetermined range between stitches to produce a pattern of feed and bight controlled stitches, means for storing pattern stitch information, means operating in timed relation with the sewing machine for recovering selected pattern stitch information from the storing means, separate actuating means responsive to the pattern stitch information for influencing the feed and bight motions respectively to produce a pattern of stitches corresponding to the selected pattern stitch information, controllable alteration means effective to alter the operation of at least one of the feed and bight actuating means to an amount of motion proportional to that dictated by the pattern stitch information, and a control member settable by an operator for controlling the alteration means, by providing a display device including a plurality of light emitting elements positioned in a regular array, means coupled to the control member for providing a display signal related to the amount of alteration effected by the alteration means, and decoder means responsive to the display signal for controlling the energization of the plurality of light emitting elements to produce a visible light pattern in the display device that is positionally related to the setting of the control member.

BRIEF DESCRIPTION OF THE DRAWINGS

The foregoing will be more readily apparent upon reading the following description in conjunction with the drawings wherein.

DETAILED DESCRIPTION

Figure 1:
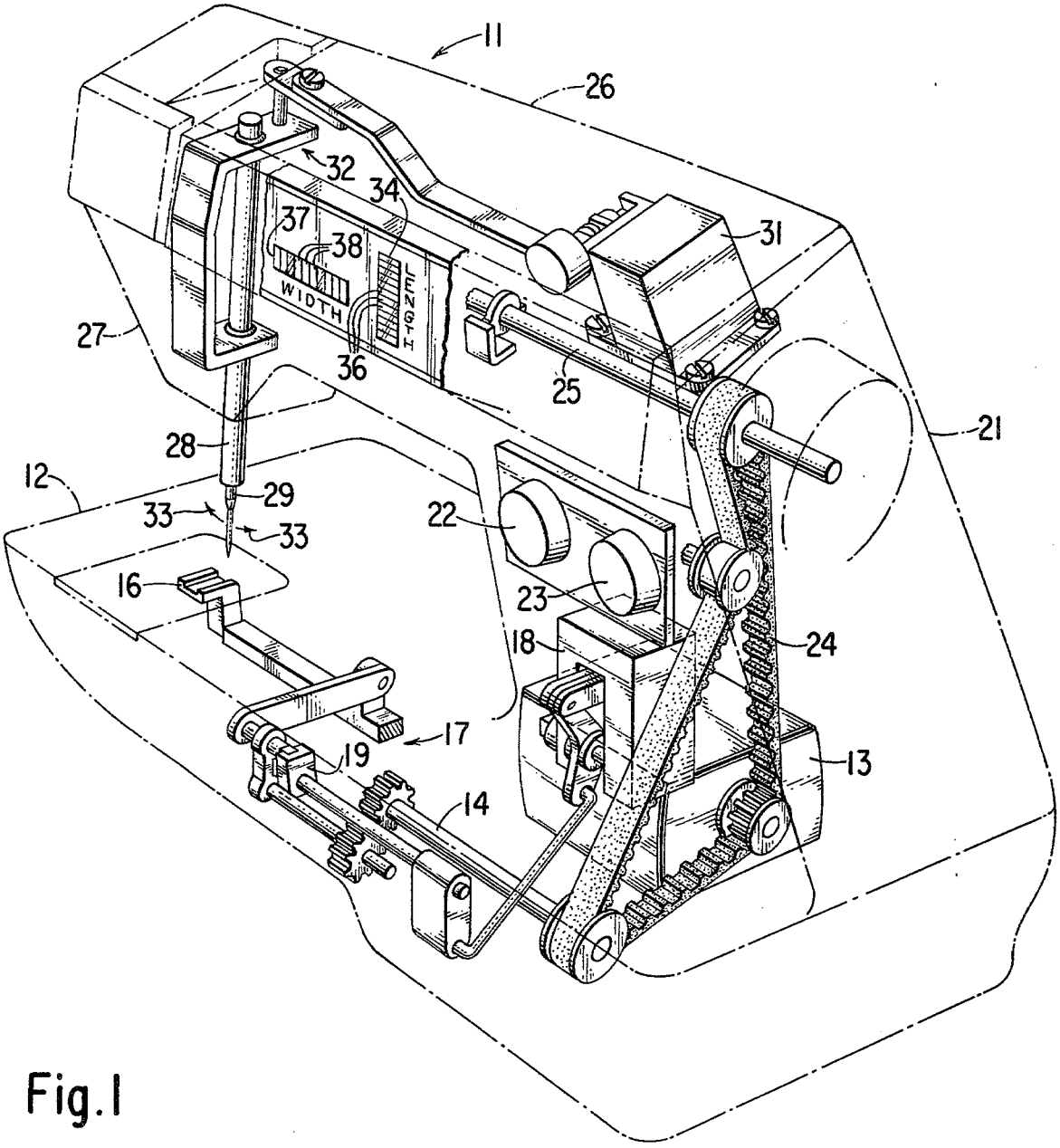
FIG. 1 is a simplified representation of a sewing machine with parts broken away to illustrate key components in the interior thereof.

Referring now to the drawings, wherein like elements in different figures thereof have the same reference character applied thereto, FIG. 1 shows an illustrative sewing machine 11 comprising a bed 12 and including a main drive motor 13 for imparting motion to the stitch forming instrumentalities. The work feed mechanism includes a feed drive shaft 14 driven by the motor 13, and a feed dog 16 connected by a suitable coupling 17 to the shaft 14. A linear motor 18, or other suitable controllable electrically responsive means capable of output motion in response to suitable input signals, is connected to a regulator 19 which is part of the feed drive mechanism. The motor 13 provides a basic drive impetus to the feed dog 16, and this impetus may be modified by the setting of the inclination of the regulator 19 in response to motion of the linear motor 18 so as to provide different amounts of feed motion, and even different directions of such motion, for each stitch in the pattern, as described for example in U.S. Pat. Nos. 3,872,808; 3,855,956, and 3,984,745, the contents of which are hereby incorporated by reference.

The machine 11 has a standard 21 on which are mounted a first control 22 for controlling the feeding of the work and a second control 23 for controlling the stitch width. A coupling from the motor 13 extends up through the standard 21 for coupling the motor 13 to an arm shaft 25 in one of the ways well known in the sewing machine art, as for example by a belt 24.

The arm shaft 25 extends along a bracket arm 26 to a head 27 where it is coupled to a needle support bar 28 to which a needle 29 is attached. In accordance with standard practice, the arm shaft 25 serves as the drive means for driving the needle support bar 28 reciprocatingly up and down. The vertical direction of movement of the needle support bar 28 is transverse to the feed direction of the feed dog 16 that forms part of the work feed mechanism.

A second linear motor 31 serves as an electrically responsive actuator connected to the needle jogging mechanism 32 in the form of a standard gate in which the needle support bar 28 is journalled to shift the needle 29 back and forth in the directions indicated by the arrows 33. This direction is transverse to both the vertical direction of movement of the needle and the horizontal direction of movement of the feed dog 16.

The first control 22 is connected to the apparatus that determines the incremental amount of feed per stitch, for example, by being connected to means, such as an electronic circuit that controls the linear motor 18, which operates through the regulator 19 to modify the amount of feed movement of the feed dog 16. The second control 23 is connected to means, such as an electronic circuit, to govern lateral jogging of the needle 29 to determine the lateral point of needle penetration for each stitch by furnishing a controllable current to the linear motor 31 in accordance with standard practice.

All of the component parts of the sewing machine 11 just described are well known in the sewing machine industry, and the machine 11 is only intended as a generally illustrative embodiment in which the invention is incorporated.

In accordance with the present invention, a display device 34 for the stitch length is mounted on the bracket arm 26. This display device includes a plurality of light emitting elements 36, illustratively semiconductive light emitting diodes (LED's), arranged in a regular array, illustratively a row. A similar display device 37 for the stitch width consisting of a plurality of LED's 38 is also arranged on the bracket arm 26. The display device 37 is oriented so that the line of LED's 38 is horizontal in accordance with the direction of movement of the needle 29 in response to the needle jogging mechanism 32. The display device 34 is oriented transversely with respect to the display device 37 in accordance with the fact that the direction of movement of the feed dog 16 is transverse to the direction of movement of the needle 29 acting in response to the needle jogging mechanism 32.

Figure 2:
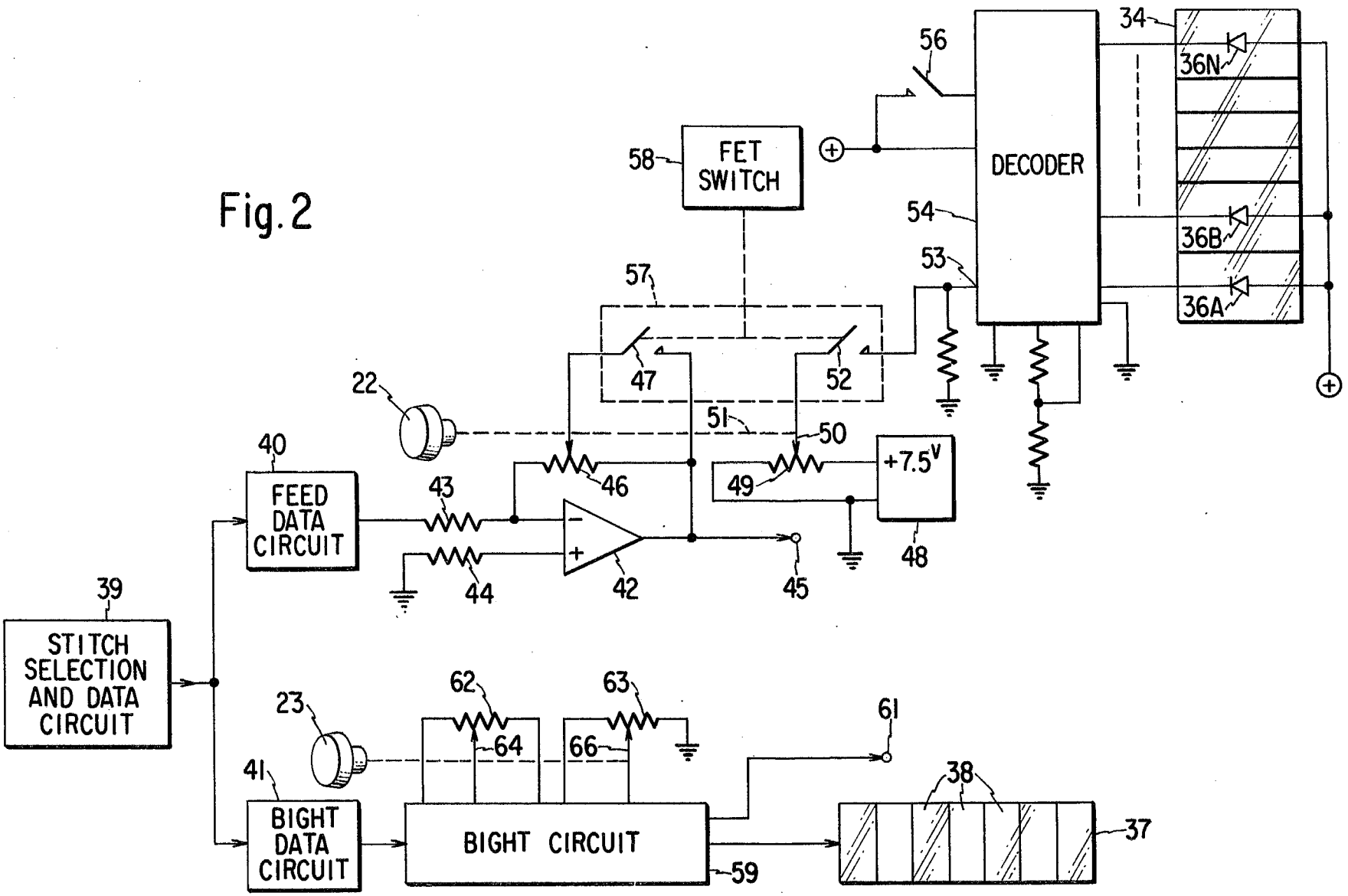
FIG. 2 is a schematic diagram of an electric circuit for controlling semiconductor display devices in accordance with this invention.

FIG. 2 shows a schematic electrical diagram of illustrative circuitry for operating the display devices 34 and 37. Information concerning the amount of incremental feed to be imparted to the work material and the amount of lateral jogging to be imparted to the needle 29 for each stitch of a selected pattern is generated in a stitch selection and data circuit 39, which includes a stitch pattern memory. This information is separated into feed data and bight data in circuits 40 and 41. Generation of the electrical signals that represent feed and bight information is not part of the present invention but may be accomplished in the manner described in U.S. Pat. Nos. 3,872,808; 3,855,956 and 3,984,745, which were mentioned previously. The feed data is connected to an operational amplifier, or op amp, 42 by way of an input resistor 43 connected between the feed data circuit 40 and the inverting terminal of the op amp 42. A suitable op amp for this purpose is an RCA 4136 integrated circuit (IC). The non-inverting input terminal of the op amp 42 is connected to ground through a resistor 44. The output voltage from the op amp 42 is passed along to an output terminal 45 that is connected to an amplifier at the input to the linear motor 18 (FIG. 1). At a suitable time during each stitch cycle, feed data signals originating from the circuit 39 emerge from the output terminal 45 and cause the linear motor 18 to regulate the work feed mechanism via the regulator 19 to cause the feed dog 16 (FIG. 1) to move either backward or forward a distance that is proper for that stitch of the selected pattern.

If the size of the pattern is to be diminished, the gain of the op amp 42 is attenuated by varying the resistance of a feedback resistor 46 connected between the output terminal 45 and the inverting terminal of the op amp 42. As shown in FIG. 2, the feedback resistor 46 is a potentiometer, the wiper arm of which is connected in series with a switch 47 to one of its end terminals, in this case the end terminal connected to the output terminal 45. In order to vary the effective resistance of the resistor 46, the switch 47 is closed, as a result of which the gain of the op amp 42 is attenuated according to the ratio $R_1/R_2$, where $R_1$ is the resistance between the wiper arm and the lefthand end of the potentiometer 46, and $R_2$ is the resistance of the resistor 43. The op amp 42 is a linear amplifier so that the output voltage applied as an operating voltage to the linear motor 18 corresponds exactly to the ratio just given. In this manner, the control of the feed mechanism is overridden to allow every feed stroke in the pattern to be diminished by the ratio $R_1/R_2$.

In accordance with this invention, the effect on the feed mechanism is displayed on the display device 34 by causing certain of the semiconductor means 36, which illustratively are LED's, to be illuminated. This is accomplished by obtaining an indicator voltage from a source 48. In the illustrative embodiment, the source 48 is simply a +7.5 volt power supply. A potentiometer 49 is connected between the positive terminal of the power supply 48 and ground to serve as a voltage divider, and a voltage is picked off at the wiper arm 50. The wiper arms of the potentiometer 49 and the potentiometer 46 are ganged together as indicated by the dotted line 51, and both are connected to the control 22. Thus, as the wiper arm of the potentiometer 46 is moved to vary the gain of the op amp 42, the wiper arm 50 of the potentiometer 49 moves in the same manner to provide a correspondingly varying indicator voltage which is a fraction of the voltage provided by the source 48. In this way, a variable voltage is obtained that could not be obtained directly from the feedback op amp 42.

The wiper arm 50 is connected through a switch 52 to an input terminal 53 of an integrated circuit 54 that operates as a decoder to analyze the magnitude of the voltage at the arm 50. A suitable IC for this purpose is a display driver LM3914, manufactured by National Semiconductor.

The decoder 54 provides suitable output terminals for supplying current to individual LED's 36A–36n in the display device 34, which may be a General Instrument bar display MV57164. The decoder 54 has two modes of operation, controlled by a switch 56. When the switch 56 is closed, a low voltage at the arm 50 of the potentiometer 49, which corresponds to low gain of the op amp 42, causes only the lowermost LED 36A to be illuminated. Slightly less attenuation, corresponding to moving the wiper arms of the potentiometers 46 and 49 slightly to the right, causes both the LED 36A and the adjacent LED 36B to be illuminated. As the control 22 is turned to cause less and less attenuation in the op amp 42, the wiper arm 50 picks off a higher and higher percentage of the output voltage of the voltage source 48 and applies this higher voltage to the input terminal 53, causing more and more of the LED's 36 in the display device 34 to be illuminated until, finally, when there is no attenuation of the gain of the op amp 42, all of the LED's 36A–36N in the display device 34 will be illuminated.

The alternative mode of operation of the decoder 54 is when the switch 56 is open. In this mode, only one of the LED's 36A–36N in the display device 34 is illuminated at any time. The LED that will be illuminated is the one that would be at the top of the illuminated group in the display device for any given setting of the control 22. For greatest attenuation, this would only be the LED 36A. For slightly less attenuation it would be the LED 36B and so on until it would finally be the LED 36N at the top of the display device 34.

While the switches 47 and 52 are indicated as mechanically operated switches, they are preferably FET switches incorporated in a Control Data type 4016 FET switch integrated circuit 57. The switch sections 47 and 52 are closed by the application of a suitable actuating voltage from a portion 58 of the same integrated circuit so that the switches 47 and 52 operate as if they were a double pole single throw switch.

The circuit in FIG. 2 also shows, in block form, a bight circuit 59 connected to the bight data circuit 41 and virtually identical to the feed circuit shown in detail and connected to the feed data circuit 40. The bight circuit 59 is, therefore, capable of providing an output signal to the display device 37 that comprises individual semiconductor LED's 38 that can be operated in the same manner as the semiconductor LED's 36 in the display device 34. The bight circuit 59 also includes an output terminal 61 to be connected to an amplifier at the input to the linear motor 31 (FIG. 1). Potentiometers 62 and 63 corresponding to potentiometers 46 and 49, respectively, in the feed circuit are also shown, and the respective wiper arms 64 and 66 of these potentiometers 62 and 63 are linked together to the bight control 23.

Thus, both the feed and bight stitch parameters can be manually modified by operation of the controls 22 and 23 to selectively vary the length and width of stitch patterns formed by the sewing machine 11 (FIG. 1) and such reduction will be graphically depicted by the pattern of light positionally produced, for example as bars or points, on the display devices 34 and 37, respectively.

While this invention has been described in terms of a specific embodiment, it will be understood by those skilled in the art that modifications may be made therein within the scope of the following claims.

I claim:

1. In a sewing machine having stitch forming instrumentalities positionally controlled over a predetermined range between stitches to produce a pattern of feed and bight controlled stitches, means for storing pattern stitch information, means operating in timed relation with said sewing machine for recovering selected pattern stitch information from said storing means, separate actuating means responsive to said pattern stitch information for influencing the feed and bight motions respectively to produce a pattern of stitches corresponding to the selected pattern stitch information, controllable alteration means effective to alter the operation of at least one of said feed and bight actuating means to an amount of motion proportional to that dictated by said pattern stitch information, and a control member settable by an operator for controlling said alteration means, the improvement comprising:

a display device including a plurality of light emitting elements positioned in a regular array;

means coupled to said control member for providing a display signal related to the amount of alteration effected by said alteration means; and decoder means responsive to said display signal for controlling the energization of said plurality of light emitting elements to produce a visible non-numerical light pattern in said display device that is positionally related to the setting of said control member.

2. The improvement according to claim 1 wherein said plurality of light emitting elements are positionally arranged in a line, and said decoder means comprises means for energizing a plurality of adjacent ones of the light emitting elements simultaneously to produce a bar of light.

3. The improvement according to claim 1 wherein said plurality of light emitting elements are arranged in a predetermined set of locations with respect to each other, and said decoder means comprises means for energizing only a selected one of said light emitting elements at one time.

4. The improvement according to claim 1 wherein said display signal providing means is operative only when an operator initiates an alteration.

5. The improvement according to claim 1 wherein said display device comprises a plurality of semiconductor light emitting diodes positioned along a straight line.

6. The improvement according to claim 1 wherein said alteration means includes an operational amplifier having a variable resistor with a wiper arm in a feedback path, said control member includes means coupled to said wiper arm for varying the effective resistance of the feedback path and consequently the gain of the operational amplifier in accordance with an operator controlled setting of said control member, and said display signal providing means includes:

a voltage source;

a voltage divider including a potentiometer having a wiper arm;

means for connecting said voltage source to said potentiometer;

means for mechanically coupling said voltage divider wiper arm to said feedback resistor wiper arm for movement therewith; and means for electrically connecting said voltage divider wiper arm to said decoder means.

7. The improvement according to claim 6 further including:

a first controllable switch connected between said feedback resistor wiper arm and one of the ends of said feedback resistor;

a second controllable switch connected between said voltage divider upper arm and said decoder means; and means responsive to operator initiation of an alteration for closing both said first and said second switches.

8. A sewing machine comprising:

stitch forming instrumentalities positionally controlled over a predetermined range between stitches to produce a pattern of feed and bight controlled stitches;

means for storing pattern stitch information;

means operating in timed relation with said sewing machine for recovering selected pattern stitch information from said storing means;

separate actuating means responsive to said pattern stitch information for influencing the feed and bight motions respectively to produce a pattern of stitches corresponding to the selected pattern stitch information;

separate controllable bight and feed alteration means effective to alter the operation of the feed and bight actuating means respectively to an amount of motion proportional to that dictated by said pattern stitch information;

a first control member settable by an operator for controlling said bight alteration means;

a first display device including a first plurality of light emitting elements positioned in a regular array;

first means coupled to said first control member for providing a first display signal related to the amount of bight alteration effected by said bight alteration means;

first decoder means responsive to said first display signal for controlling the energization of said first plurality of light emitting elements to produce a first visible non-numerical light pattern in said first display device that is positionally related to the bight alteration;

a second control member settable by an operator for controlling said feed alteration means;

a second display device including a second plurality of light emitting elements positioned in a regular array;

second means coupled to said second control member for providing a second display signal related to the amount of feed alteration effected by said feed alteration means; and second decoder means responsive to said second display signal for controlling the energization of said second plurality of light emitting elements to produce a second visible light pattern in said second display device that is positionally related to the feed alteration.

9. The sewing machine according to claim 8 wherein said first plurality of light emitting elements are positionally arranged in a first straight line and said second plurality of light emitting elements are positionally arranged in a second straight line transverse to said first straight line.

* * * * *